US007222678B2

(12) United States Patent
Shim

(10) Patent No.: US 7,222,678 B2
(45) Date of Patent: May 29, 2007

(54) SPRINKLER HEAD

(75) Inventor: Dae-Min Shim, Seoul (KR)

(73) Assignees: Paradise Industry Co., Ltd., Bucheon, Gyeonggi-Do (KR); Tadashi Hattori, Osaka (JP)

( * ) Notice: Subject to any disclaimer, the term of this patent is extended or adjusted under 35 U.S.C. 154(b) by 0 days.

(21) Appl. No.: 10/520,041

(22) PCT Filed: Mar. 10, 2004

(86) PCT No.: PCT/KR2004/000492

§ 371 (c)(1),
(2), (4) Date: Dec. 30, 2004

(87) PCT Pub. No.: WO2004/080542

PCT Pub. Date: Sep. 23, 2004

(65) Prior Publication Data

US 2006/0037761 A1 Feb. 23, 2006

(30) Foreign Application Priority Data

| | | |
|---|---|---|
| Mar. 10, 2003 | (KR) | 10-2003-0014696 |
| Sep. 29, 2003 | (JP) | 2003-337223 |
| Oct. 15, 2003 | (KR) | 10-2003-0071825 |
| Mar. 9, 2004 | (KR) | 10-2004-0015932 |

(51) Int. Cl.
*A62C 37/08* (2006.01)

(52) U.S. Cl. ..... 169/37; 169/38; 169/40; 169/56; 169/59

(58) Field of Classification Search ..... 169/37, 169/39, 40, 41, 56, 57, 59
See application file for complete search history.

(56) References Cited

U.S. PATENT DOCUMENTS

| | | | | |
|---|---|---|---|---|
| 4,651,832 | A * | 3/1987 | Kubo | 169/39 |
| 4,926,946 | A * | 5/1990 | Polan | 169/37 |
| 5,072,792 | A * | 12/1991 | Simons et al. | 169/37 |
| 5,083,616 | A * | 1/1992 | Polan | 169/40 |
| 5,372,203 | A | 12/1994 | Galaszewski | |
| 5,497,834 | A * | 3/1996 | Onuki | 169/37 |
| 6,044,912 | A * | 4/2000 | Tsuji et al. | 169/37 |
| 6,840,329 | B2 | 1/2005 | Kikuchi et al. | |

FOREIGN PATENT DOCUMENTS

| | | |
|---|---|---|
| GB | 2 402 635 A | 12/2004 |
| KR | 20-1989-0004965 | 10/1993 |
| KR | 10-22040015932 | 9/2005 |

* cited by examiner

*Primary Examiner*—Dinh Q. Nguyen
(74) *Attorney, Agent, or Firm*—Cohen Pontani Lieberman & Pavane LLP

(57) ABSTRACT

A sprinkler head comprises: a locking unit locked inside a second housing for maintaining a sealing state between a deflector and a first housing; a heat responding unit exposed to outside of a ceiling for releasing the locked state of the locking unit by reacting to fire when fire breaks out; and a head cover mounted at a lower side of the heat responding unit and transmitting heat to the heat responding unit after collecting heat at the time of a fire occurrence. According to this, a fine appearance of the sprinkler head is provided, and the head cover performs a heat collecting function at the time of a fire occurrence thus to have a fast reaction speed, thereby enhancing a function of the sprinkler head.

19 Claims, 13 Drawing Sheets

SPRINKLER HEAD

PRIORITY CLAIM

This is a U.S. national stage of application No. PCT/KR2004/000492, filed on 10 Mar. 2004. Priority is claimed on the following application(s): Country: South Korea, Application No.: 10-2003-0014696, Filed: 10 Mar. 2003; Country: Japan, Application No.: 2003-337223, Filed: 29 Sept. 2003; Country: South Korea, Application No.: 10-2003-0071825, Filed: 15 Oct. 2003; Country: South Korea, Application No.: 10-2004-0015932, Filed: 9 Mar. 2004, the content of which is incorporated here by reference.

TECHNICAL FIELD

The present invention relates to a sprinkler head, and more particularly, to a sprinkler head capable of performing a fast fire extinguishment by quickening a reaction speed at the time of a fire occurrence and capable of making an indoor appearance to be fine.

BACKGROUND ART

FIG. 1 is a sectional view showing a sprinkler head in accordance with the conventional art.

The conventional sprinkler head comprises: a first housing 104 connected to a water supply pipe 102 disposed inside a building ceiling 106; a second housing 110 coupled to the first housing 104 and disposed at a penetration hole 108 formed at the ceiling 106; a deflector 112 disposed in the second housing 110 and adhered to the first housing 104 in a sealing-available manner, for maintaining a sealing state of the first housing 104 in the ordinary time and spraying water all around at the time of a fire occurrence by being detached from the first housing 104; a locking unit 114 locked at an inner circumferential surface of a lower end of the second housing 110 for supporting the deflector 112 and thus maintaining the sealing state of the first housing 104; a heat responding unit 116 mounted at a lower side of the locking unit 114 for sensing heat at the time of a fire occurrence and thus releasing a locking of the locking unit 114; and a head cover 160 for covering the heat responding unit 116 thereby to protect the heat responding unit 116 and making an appearance of a part exposed to outside to be fine.

The deflector 112 includes: a deflector ring 130 inserted into an outer circumferential surface of a lower side of the first housing 104 in a linear-movable manner; a sealing cap 134 adhered to a lower surface of the first housing 104 for sealing the first housing 104; a water spray plate 136 fixed to an outer circumferential surface of the sealing cap 134 for spraying water all around at the time of a fire occurrence; and a plurality of supporters 132 for connecting the deflector ring 130 and the water spray plate 136.

The locking unit 114 includes: a first loading plate 120 contacting a lower surface of the sealing cap 134 of the deflector 112, having a screw hole 128 at the center thereof, and having an inclination surface at the edge thereof; a second loading plate 122 facing the first loading plate 120 and having an inclination surface at the edge thereof; and a locking ring 124 disposed at the inclination surface between the first loading plate 120 and the second loading plate 122 and widened when the first loading plate 120 and the second loading plate 122 are adhered to each other thus to be locked in a locking groove 126 formed at an inner circumferential surface of a lower side of the second housing 110.

The heat responding unit 116 includes: a plurality of heat collecting plates 152, 154, and 156 mounted at a lower side of the second loading plate 122 for heat-collecting at the time of a fire occurrence; a fuse metal 140 mounted at lower surfaces of the heat collecting plates 152, 154, and 156 and melted when heat transmitted through the heat collecting plates 152, 154, and 156 reaches a certain temperature; and a locking screw 142 coupled to the screw hole 128 formed at the first loading plate 120 for integrally coupling the first and second loading plates 120 and 122, the heat collecting plates 152, 154, and 156, and the fuse metal 140.

The head cover 160 is composed of a cylindrical protection container 162 coupled to an outer circumference surface of a lower side of the second housing 110, and a cover plate 164 adhered to a lower surface of the protection container 162.

The protection container 162 and the cover plate 164 are adhered to each other by a lead 166, so that the lead 166 is melted when the temperature reaches a certain degree and thereby the cover plate 166 is separated from the protection container 162.

In the sprinkler head according to the first embodiment of the conventional art, at the time of a fire occurrence, firstly, an indoor temperature is increased and thereby the lead 166 adhered between the protection container 162 and the cover plate 166 is melted thus to separate the protection container 162 from the cover plate 164.

Secondly, the heat collecting plates 152, 154, and 156 disposed inside the protection container 162 are heated thus to transmit heat to the fuse metal 140 mounted at the lower side of the heat collecting plates 152, 154, and 156. When the temperature of the heat transmitted to the fuse metal 140 reaches a certain degree, the fuse metal 140 is melted thus to widen the interval between the first loading plate 120 and the second loading plate 122. According to this, the locking ring 124 is restored to the original state thereby to be detached from the locking groove 126 formed at the second housing 110.

Then, the locking unit 114 and the heat responding unit 116 are detached from the second housing 110, and the deflector 112 is moved downwardly, thereby locking the deflector ring 130 into the locking groove 126 of the second housing 110. At this time, the sealing state of the second housing 110 is released and thereby water is drained through the second housing 110. The water is sprayed all around by the water spray plate 136 of the deflector 112 thus to extinguish fire.

However, in the sprinkler head according to the first embodiment of the conventional art, the cover plate 164 is detached from the protection container 162 firstly by heat at the time of a fire occurrence, and then the heat collecting plates 152, 154, and 156 disposed inside the protection container 162 are heated secondly thus to perform a heat responding operation. According to this, a reaction speed is slow and a water spraying time is delayed thus to have a difficulty in extinguishing the initial fire and have a problem that the fire spreads seriously.

DISCLOSURE OF THE INVENTION

Therefore, it is an object of the present invention to provide a sprinkler head having a fine appearance by installing a head cover at a part of the sprinkler head exposed to outside and capable of enhancing a performance thereof by quickening a reaction speed by making the head cover perform a heat collection function at the time of a fire occurrence.

Another object of the present invention is to provide a sprinkler head capable of enhancing a reliability by preventing an erosion and a mis-operation of the sprinkler head by preventing foreign materials, moisture, and etc. from being introduced into the sprinkler head by sealing the sprinkler head.

To achieve these objects, there is provided a sprinkler head comprising: a first housing connected to a water supply pipe; a second housing coupled to the first housing; a deflector adhered to the first housing in a sealing-available manner, for spraying water all around at the time of a fire occurrence by being detached from the first housing; a locking unit locked inside the second housing for maintaining the sealing state between the deflector and the first housing; a plurality of heat collecting plates exposed to outside of the ceiling, for heat-collecting at the time of a fire occurrence; a heat responding unit having a fuse metal for releasing the locking state of the locking unit by being melted by heat collected into the heat collecting plates; and a head cover mounted at a lower side of the heat responding unit with a certain interval for covering the heat responding unit not to expose to outside and heat-collecting at the time of a fire occurrence and thereby transmitting the heat to the heat responding unit.

The head cover of the sprinkler head includes: a disc for heat-collecting; a heat transmission plate attached to the center of an upper surface of the disc, for transmitting heat collected by the disc to the heat responding unit; and a couple member formed at an upper surface of the heat transmission plate and coupled to the heat responding unit.

The disc of the head cover has a diameter larger than diameters of the plurality of heat collecting plates, is provided with a flange portion protruded upwardly at the outer edge thereof, and is provided with a plurality of ribs formed with a certain interval in a circumferential direction thereof.

A certain interval is formed between an upper surface of the flange portion of the disc of the head cover and the ceiling surface in order to introduce heated air into the heat collecting plates.

The heat transmission plate of the head cover is mounted between the heat collecting plates and the disc and has a certain thickness for maintaining a certain clearance therebetween.

The sprinkler head further comprises a cover member coupled to an outer circumferential surface of the second housing and adhered to the ceiling surface, for covering an opening of the ceiling.

The sprinkler head further comprises a hole cover mounted at the outer circumferential surface of the second housing, for covering a tool insertion hole formed at the second housing.

MODES FOR CARRYING OUT THE PREFERRED EMBODIMENTS

Hereinafter, a sprinkler head according to the present invention will be explained as follows.

Even if a plurality of preferred embodiments of the sprinkler head exist, the most preferred embodiment will be explained hereinafter.

Figure 1:
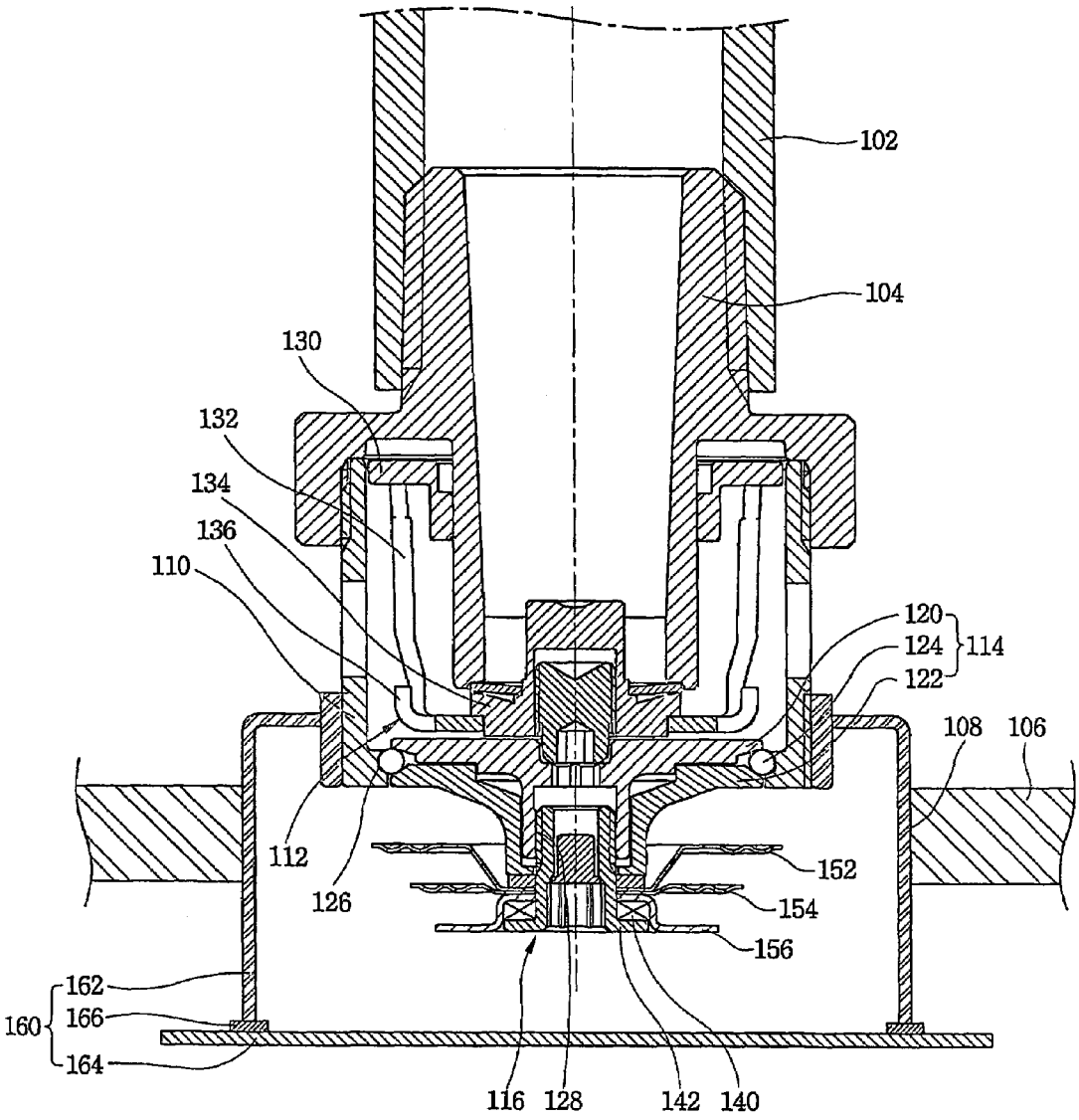
FIG. 1 is a sectional view of a sprinkler head in accordance with the conventional art.
Figure 2:
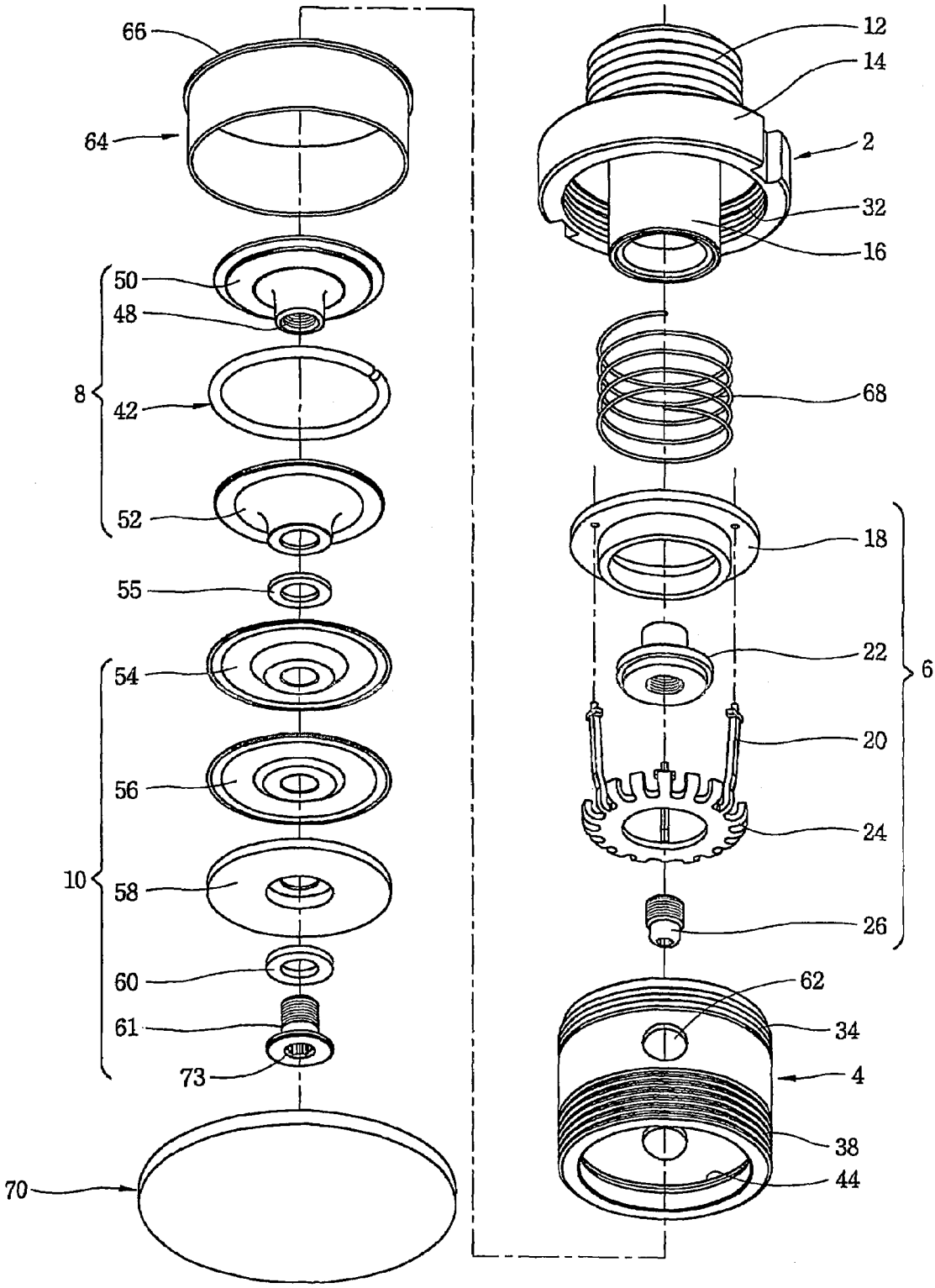
FIGS. 2 and 3 are disassembled perspective views of a sprinkler head according to one embodiment of the present invention.
Figure 3:
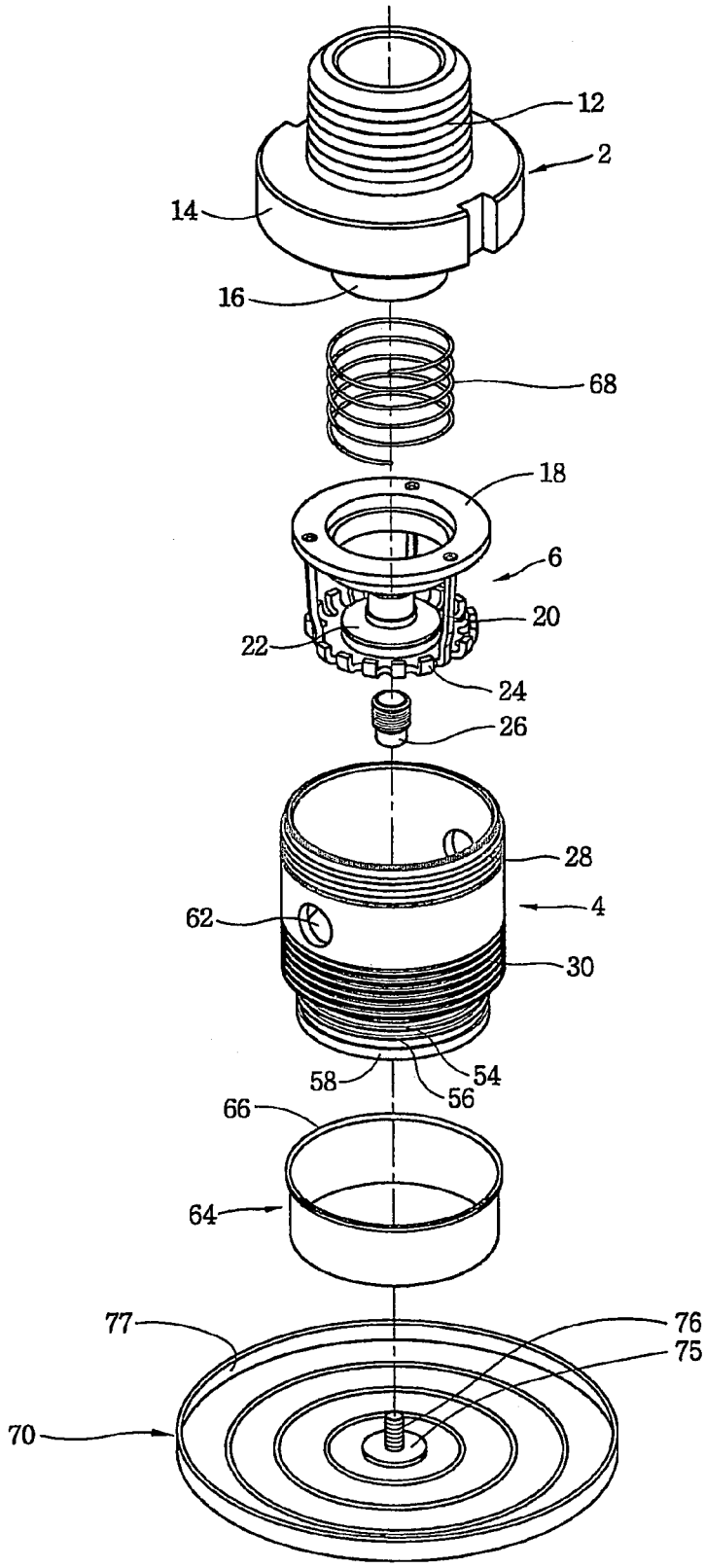
Figure 4:
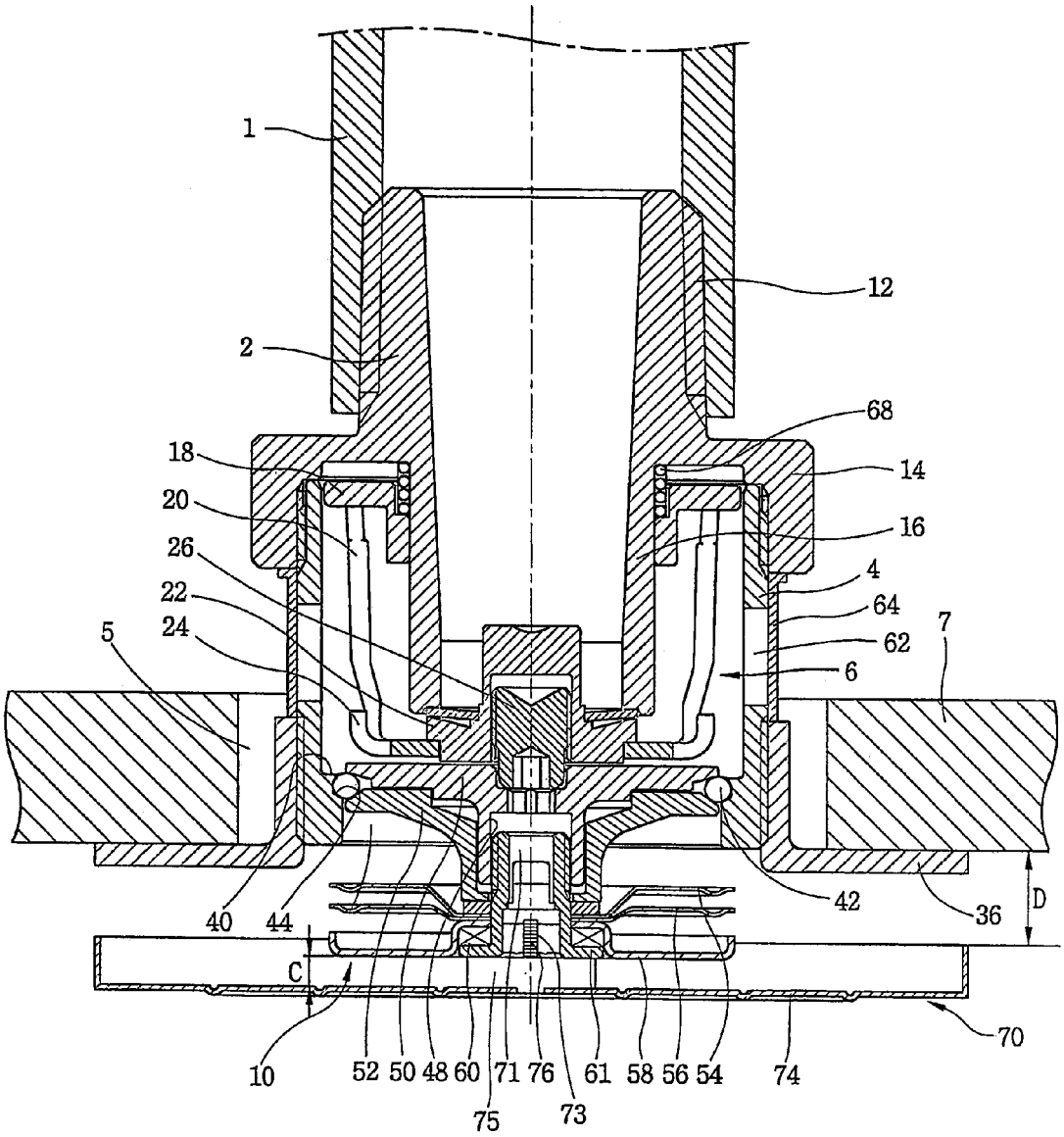
FIG. 4 is an engagement sectional view of the sprinkler head according to one embodiment of the present invention.

FIGS. 2 and 3 are disassembled perspective views of a sprinkler head according to one embodiment of the present invention, and FIG. 4 is a sectional view of the sprinkler head according to one embodiment of the present invention which is mounted to the ceiling.

The sprinkler head according to the present invention comprises: a first housing 2 connected to a water supply pipe 1 disposed inside a building ceiling 7; a second housing 4 coupled to the first housing 2 and disposed at an opening 5 formed at the ceiling 7; a deflector 6 disposed in the second housing 4 and adhered to the first housing 2 in a sealing-available manner, for sealing the first housing 2 in the ordinary time and spraying water all around at the time of a fire occurrence by being detached from the first housing 2; a locking unit 8 locked at an inner circumferential surface of the second housing 4 for supporting the deflector 6 so that the first housing 2 can be sealed; and a heat responding unit 10 exposed to outside of the ceiling 7 for sensing heat at the time of a fire occurrence and thus releasing a locking of the locking unit 8.

The first housing 2 includes: a male screw portion 12 formed at the upper portion of the first housing 2 and connected to the water supply pipe 1; a flange portion 14 formed at the middle portion of the first housing 2 and having a female screw portion 32 at an inner circumferential surface thereof so as to be coupled to the second housing 4; and a water emitting portion 16 formed at a lower portion of the first housing 2 and into which the deflector 6 is ascendably and descendably inserted, for emitting water.

The second housing 4 is formed as a cylindrical shape, and includes a first male screw portion 34 formed at an upper outer circumferential surface thereof and connected to the female screw portion 32 of the first housing 2; and a second male screw portion 38 formed at a lower outer circumferential surface thereof and connected to a cover member 36 for covering the opening 5 of the ceiling 7. Also, a tool insertion hole 62 for supporting the deflector 6 so that the deflector 6 can not be rotated but can be adhered to a lower surface of the water emitting portion 16 of the first housing 2 is formed at the middle side of the second housing 4.

Also, a locking protrusion 40 for locking the deflector 6 is protruded with a certain width at an inner circumferential surface of the second housing 4 in a circumferential direction, and the locking protrusion 40 is provided with a locking groove 44 formed in a circumferential direction for locking a locking ring 42 of the locking unit 8 by an insertion.

A hole cover 64 for covering the tool insertion hole 62 and thereby preventing foreign materials or moisture from being introduced into the second housing 4 through the tool insertion hole 62 is mounted at the outer circumferential surface of the second housing 4.

The hole cover 64 is adhered to the outer circumferential surface between the first male screw portion 34 and the second male screw portion 38 of the second housing 4, and is formed as a ring shape for covering the tool insertion hole 62. At an upper surface of the hole cover 64, formed is a rib 66 curved outwardly so as to be adhered to a lower surface of the flange portion 14 of the first housing 2. The hole cover 64 is forcibly inserted onto the outer circumferential surface of the second housing 4 thus to be adhered thereto.

The deflector 6 includes: a deflector ring 18 linear-movably inserted to an outer circumferential surface of the water emitting portion 16 and locked by the locking protrusion 40 of the second housing 4 when the deflector 6 is detached from the first housing 2; a sealing cap 22 adhered to a lower surface of the water emitting portion 16 of the first housing 2 for sealing the water emitting portion 16; a water spray plate 24 fixed to an outer circumferential surface of the sealing cap 22 for spraying water all around at the time of a fire occurrence; and a plurality of supporters 20 for connecting the deflector ring 18 and the water spray plate 24.

A set screw 26 is formed at a lower surface of the sealing cap 22. If the set screw 26 is loosened, the deflector 6 is ascended and thereby the sealing cap 22 is adhered to the water emitting portion 16 thus to seal the water emitting portion 16. At this time, a tool is inserted through the tool insertion hole 62 formed at the second housing 4 thus to support the supporters 20, thereby preventing the deflector 6 from being rotated.

A spring 68 is disposed between an upper surface of the deflector ring 18 of the deflector 6 and an inner side surface of the flange portion 14 of the first housing 2, thereby providing a certain elastic force to the deflector 6 when the deflector 6 downwardly moves accordingly as the locking of the locking unit 8 is released.

The locking unit 8 includes: a first loading plate 50 contacting a lower surface of the sealing cap 22 of the deflector 6 and having a screw hole 48 at the center thereof; a second loading plate 52 facing the first loading plate 50; and a locking ring 42 disposed at the edge between the first loading plate 50 and the second loading plate 52 and locked at the locking groove 44 formed at the second housing 4 by being widened when the first loading plate 50 and the second loading plate 52 are adhered to each other.

The first loading plate 50 and the second loading plate 52 are respectively provided with an inclination surface at the edge of the opposing surface, and a locking ring 42 is positioned between said two inclination surfaces. According to this, if the locking screw 61 is tightened, the first loading plate 50 and the second loading plate 52 are adhered to each other and thereby the locking ring 42 is widened along the inclination surfaces thus to be locked at the locking groove 44 of the second housing 4.

The locking groove 44 is formed at the inner circumferential surface of the second housing 4 with a certain height from a lower surface of the second housing 4. According to this, the locking ring 42 locked at the locking groove 44 and the first and second loading plates 50 and 52 are disposed with a state of being inserted to the inner surface of the second housing 4.

The heat responding unit 10 includes: a plurality of heat collecting plates 54, 56, and 58 mounted at a lower side of the second loading plate 52 for collecting heat at the time of a fire occurrence; a fuse metal 60 disposed at a lower surface of the heat collecting plates 54, 56, and 58 and melted when heat collected through the heat collecting plates 54, 56, and 58 reaches a certain temperature; a locking screw 61 coupled to the screw hole 48 formed at the first loading plate 50 for integrally coupling the first and second loading plates 50 and 52, the heat collecting plates 54, 56, and 58, and the fuse metal 60; and a head cover 70 mounted at a lower side of the heat collecting plate 58 with a certain interval for covering the heat collecting plates not to expose to outside and heat-collecting at the time of a fire occurrence.

Centers of the heat collecting plates 54, 56, and 58 are penetrated so that the locking screw 61 can pass. The first heat collecting plate 54 is disposed at a lower surface of the second loading plate 52 with a certain interval with the second loading plate 52, and the second heat collecting plate 56 is disposed with a certain interval with the first heat collecting plate 54. Also, the third heat collecting plate 58 is disposed with a certain interval with the second heat collecting plate 56 and is provided with the fuse metal 60 at the lower surface thereof. An insulating washer 55 is mounted between the second loading plate 52 and the first heat collecting plate 54, thereby preventing heat collected into the first heat collecting plate 54 from being transmitted to the second loading plate 52.

The first, second, and third heat collecting plates 54, 56, and 58 have the same diameter, and are disposed with a certain interval one another so that heated air can pass.

The locking screw 61 is provided with a penetration hole 71 for passing a tool such as a wrench, and the penetration hole 71 is provided with a screw groove 73 to which the head cover 70 is coupled.

Figure 5:
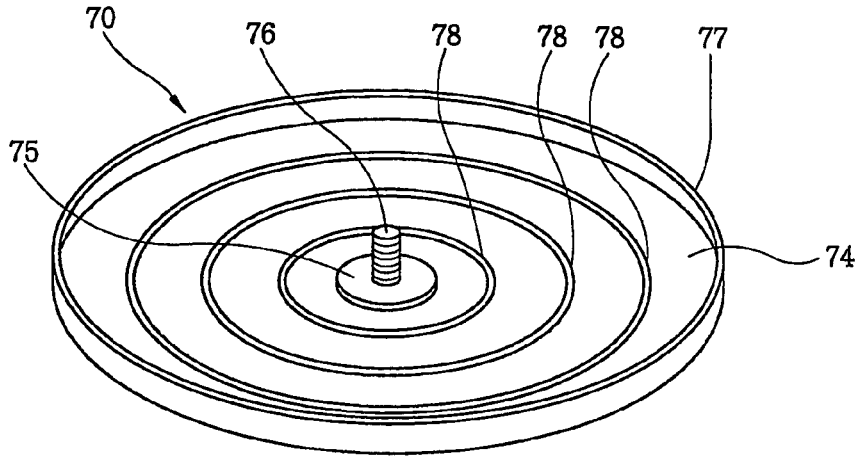
FIG. 5 is a perspective view of a head cover according to one embodiment of the present invention.

FIG. 5 is a perspective view of a head cover according to one embodiment of the present invention.

The head cover 70 includes: a disc 74 formed as a disc shape for heat-collecting; a heat transmission plate 75 attached to the center of an upper surface of the disc 74, for transmitting heat collected by the disc 74 to the fuse metal 60; and a couple member 76 upwardly protruded from an upper surface of the heat transmission plate 75 and coupled to the screw groove 73 of the locking screw 61.

The disc 74 has a diameter larger than diameters of the first, second, and third heat collecting plates 54, 56, and 58, and is provided with a flange portion 77 upwardly protruded with a certain with from the outer edge thereof. A plurality of ribs 78 are formed at a circumference of the disc 74 with a certain interval thus to strengthen an intensity of the disc 74, thereby preventing the disc 74 from being deformed.

It is preferable that the thickness of the disc 74 is 0.2mm~0.5mm and the outer diameter thereof is 40mm~100mm. It is preferable that the height of the flange portion 77 is 2mm~4mm.

The heat transmission plate 75 is formed of a material that can easily transmit heat, and is in contact with the lower surface of the locking screw 61 thus to transmit heat to the fuse metal 60. Also, the heat transmission plate 75 has a certain thickness thus to maintain a certain clearance C between the third heat collecting plate 58 and the disc 74.

It is preferable that a diameter of the heat transmission plate 75 is formed to be smaller than a diameter of a head portion of the locking screw 61.

Since the head cover 70 and the ceiling 7 maintain a certain interval D, heated air is introduced into the interval thus to be transmitted to the first, second, and third heat collecting plates 54, 56, and 58.

It is preferable that the couple member 76 is composed of a screw bar coupled to the screw groove 73 of the locking screw 61.

Figure 6:
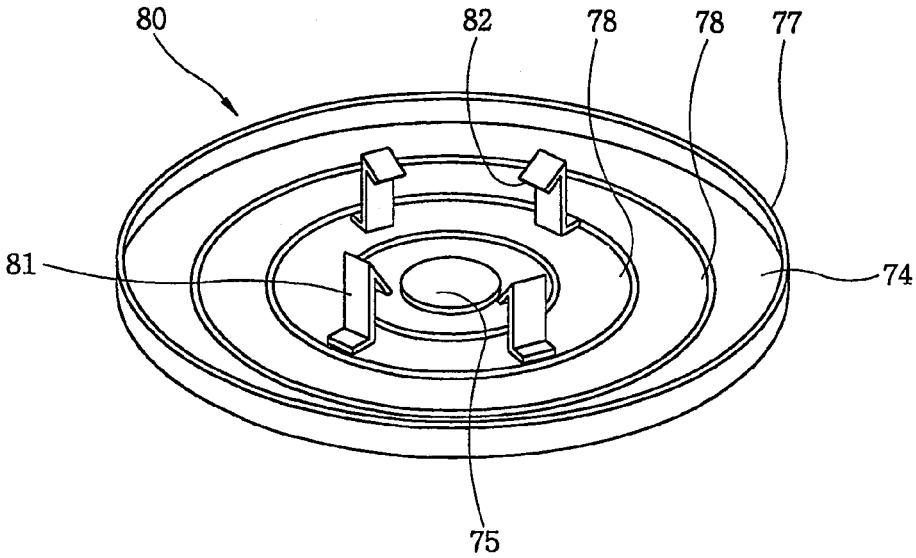
FIG. 6 is a perspective view of a head cover according to another embodiment of the present invention.
Figure 7:
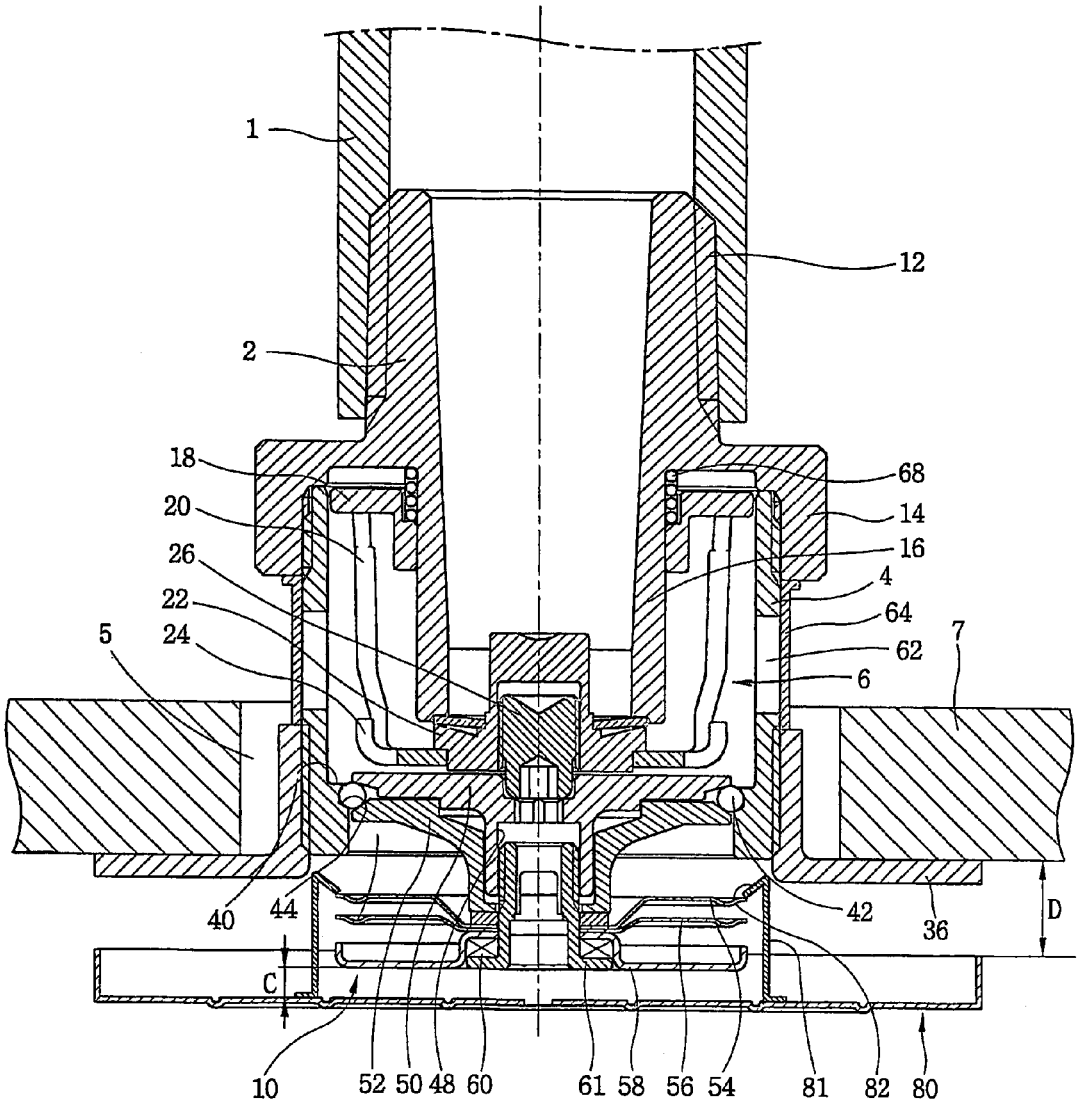
FIG. 7 is a sectional view of a sprinkler head to which the head cover according to another embodiment of the present invention is mounted.

FIG. 6 is a perspective view of a head cover according to another embodiment of the present invention, and FIG. 7 is a sectional view of a sprinkler head to which the head cover according to another embodiment of the present invention is mounted.

A head cover 80 according to another embodiment of the present invention includes: a disc 74 formed as a disc shape for heat-collecting; a heat transmission plate 75 attached to the center of an upper surface of the disc 74, for transmitting heat collected by the disc 74 to the fuse metal 60; and a locking hook 81 disposed at an upper surface of the disc 74 in a circumferential direction with a certain interval thus to be locked at the first heat collecting plate 54.

The disc 74 and the heat transmission plate 75 have the same structures as those of the first embodiment. The locking hook 81 is attached to the upper surface of the disc 74 in the circumferential direction thus to be extended perpendicularly, and the end portion of the locking hook 81 is provided with a locking protrusion 82 curved inwardly thus to be locked at the upper surface of the first heat collecting plate 54.

An assembly structure of the head cover according to the second embodiment will be explained. First, when the head cover 80 is inserted into the locking unit 10 from a lower direction to an upper direction, the locking protrusion 82 of the locking hook 81 is locked at the upper surface of the first heat collecting plate 54 and thereby the head cover 80 maintains a fixed state. At this time, the heat transmission plate 75 is in contact with the lower surface of the locking screw 61.

Figure 8:
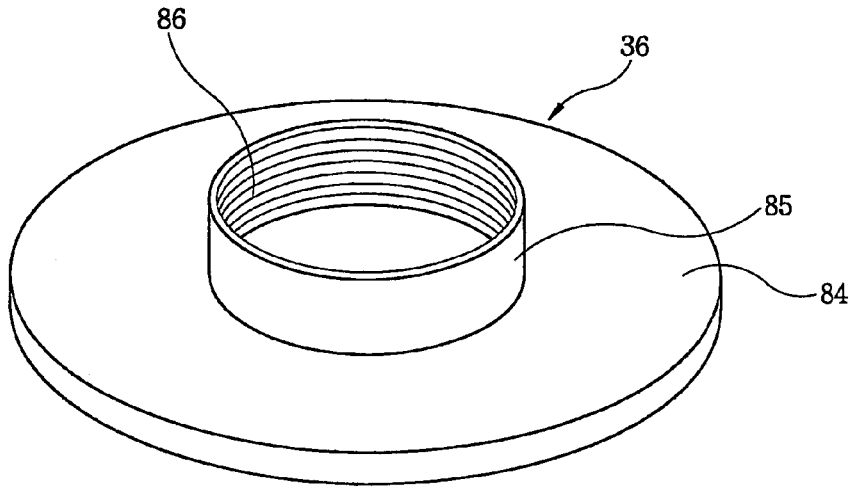
FIG. 8 is a perspective view of a cover member according to one embodiment of the present invention.

FIG. 8 is a perspective view of a cover member according to one embodiment of the present invention.

A cover member 36 according to the first embodiment includes: a plate portion 84 formed as a disc shape and adhered to an outer side surface of the ceiling 7; and a couple portion 85 protruded from an upper side surface of the plate portion 84 thus to be coupled to the second male screw portion 30 of the second housing 4. The couple portion 85 is protruded with a certain with as a cylindrical shape, and is provided with a female screw portion 86 coupled to the second male screw portion 30 at the inner circumferential surface thereof.

The cover member 36 covers the opening 5 of the ceiling 7 since the plate portion 84 is adhered to the outer side surface o the ceiling 7 and the couple portion 85 is coupled to the second housing 4, thereby preventing peripheral heat of the sprinkler head from being leaked out through the opening 5 at the time of a fire occurrence and thereby enhancing a responsiveness of the sprinkler head.

Figure 9:
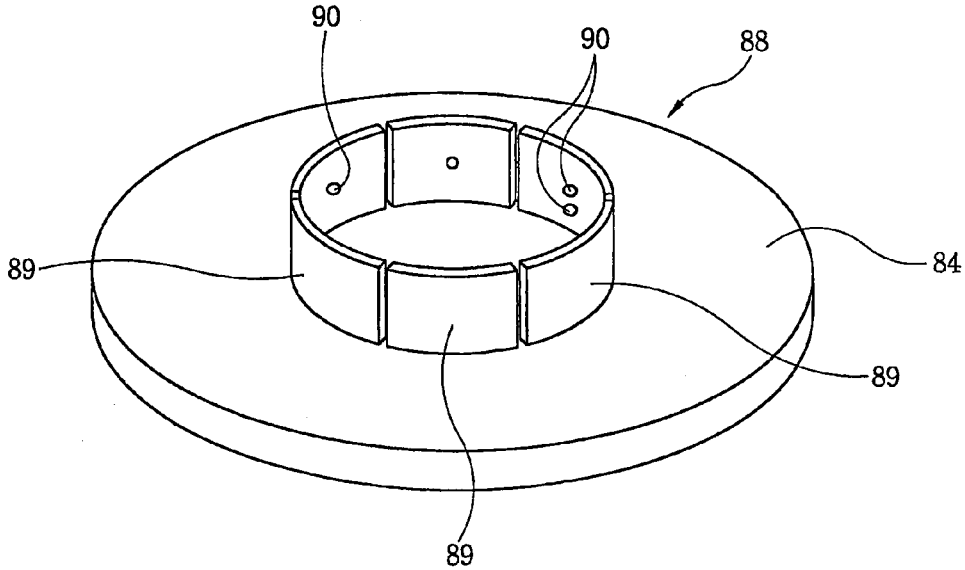
FIG. 9 is a perspective view of a cover member according to another embodiment of the present invention.

FIG. 9 is a perspective view of a cover member according to another embodiment of the present invention.

A cover member 88 according to another embodiment of the present invention is composed of: a plate portion 84 of which the center is formed as an open disc shape and adhered to the ceiling 4; and a plurality of supporting ribs 89 formed at an upper surface of the plate portion 84 in a circumferential direction with a certain interval and provided with a plurality of protrusions 90 locked at the second male screw portion 30 of the second housing 4 at the inner surface thereof.

An assembly process of the sprinkler head according to the present invention will be explained as follows.

First, the deflector 6 is inserted onto the outer circumferential surface of the water emitting portion 16 of the first housing 2, thereby adhering the sealing cap 22 of the deflector 6 to the lower surface of the water emitting portion 16.

Then, the first loading plate 50, the locking ring 42, and the second loading plate 52 are sequentially disposed from the lower side of the second housing 4 to the inner side thereof. Then, the plurality of heat collecting plates 54, 56, and 58 and the fuse metal 60 are positioned at the lower side of the second loading plate 52, and the locking screw 61 is coupled to the screw hole 48 of the first loading plate 50. Then, a proper torque is applied to the locking screw 61, so that the first loading plate 50 and the second loading plate 52 are adhered to each other. According to this, the locking ring 42 is widened along the inclination surfaces of the first loading plate 50 and the second loading plate 52, thereby being inserted into the locking groove 44 formed at the second housing 4.

The locking unit 8 and the heat responding unit 10 are coupled to the second housing 4, and then the first male screw portion 34 of the second housing 4 is coupled to the female screw portion 32 formed at the flange portion 14 of the first housing 2. According to this, the set screw 26 coupled to the deflector 6 is in contact with the upper surface of the first loading plate 50.

Under this state, a tool is inserted through the tool insertion hole 90 formed at the second housing 4 thereby to support the supporter 20 of the deflector 6 so that the deflector 6 can not be rotated. Then, the tool is inserted into the penetration hole 96 formed at the locking screw 61 thus to loosen the set screw 26. At this time, since the set screw 26 is in a state of being supported at the first loading plate 50, the deflector 6 is relatively ascended and the sealing cap 22 is adhered to the lower surface of the water emitting portion 16 of the first housing 2 thereby to seal the water emitting portion 16.

When the sealing operation of the water emitting portion 16 is completed, the hole cover 92 is forcibly inserted onto the outer circumferential surface of the second housing 4 thereby to seal the tool insertion hole 90 formed at the second housing 4.

Then, the couple portion of the head cover is coupled to the locking screw 61 thereby to complete the assembly.

Operation of the sprinkler head according to the present invention will be explained as follows.

Figure 10:
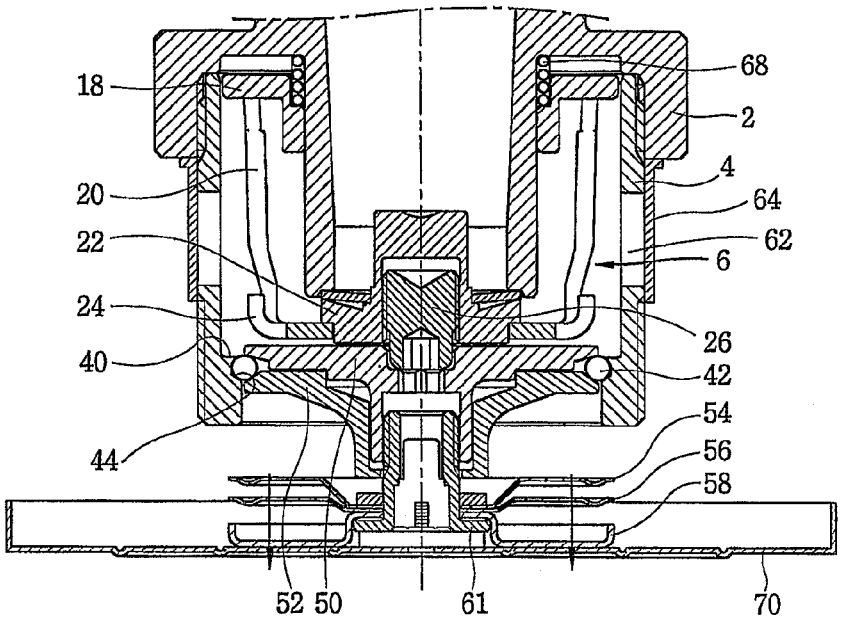
FIGS. 10, 11, and 12 are operation state views of a sprinkler head according to the present invention.
Figure 11:
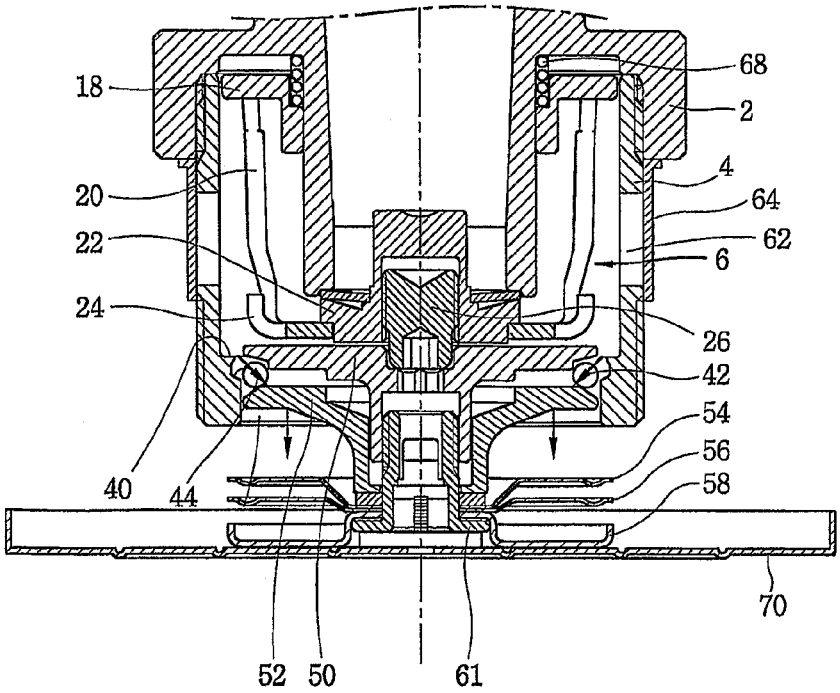
Figure 12:
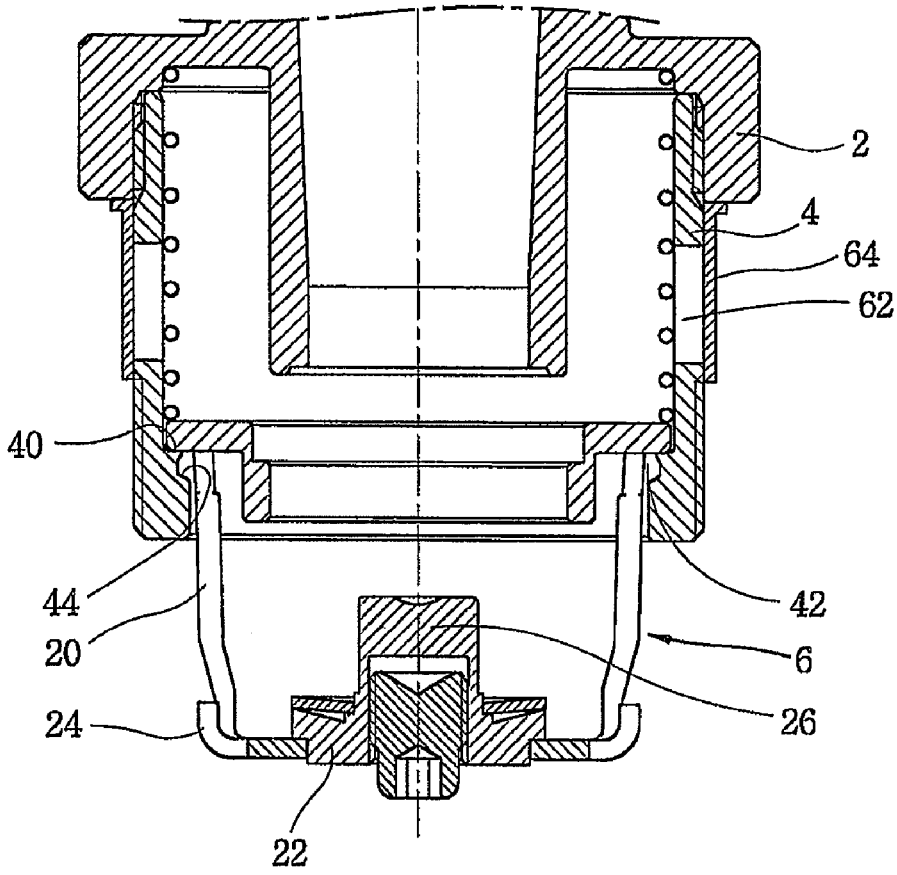

FIGS. 10, 11, and 12 are operation state views of the sprinkler head according to the present invention.

As shown in FIG. 10, under a state that the sprinkler head is mounted at the ceiling 60, air heated at the time of a fire occurrence rises thus to be collected into the head cover 70 and at the same time to be collected into the heat collecting plates 54, 56, and 58 through the space between the head cover 70 and the ceiling 7.

The heat collected into the head cover 70 is transmitted to the fuse metal 60 through the heat transmission plate 75, and the heat collected into the heat collecting plates 54, 56, and 58 is transmitted to the fuse metal 60, thereby fast melting the fuse metal 60.

Then, as shown in FIG. 11, the interval between the first loading plate 50 and the second loading plate 52 is widened, so that the locking ring 42 restores to the original state thereby to be separated from the locking groove 44. According to this, the locking unit 8 and the heat responding unit 10 are separated from the second housing.

Next, as shown in FIG. 12, after the deflector 6 is separated from the first housing 2, the deflector 6 is locked at the locking protrusion 40 formed at the second housing 2. According to this, water drained through the second housing 4 spreads through the water spray plate 24 thus to extinguish fire.

Figure 13:
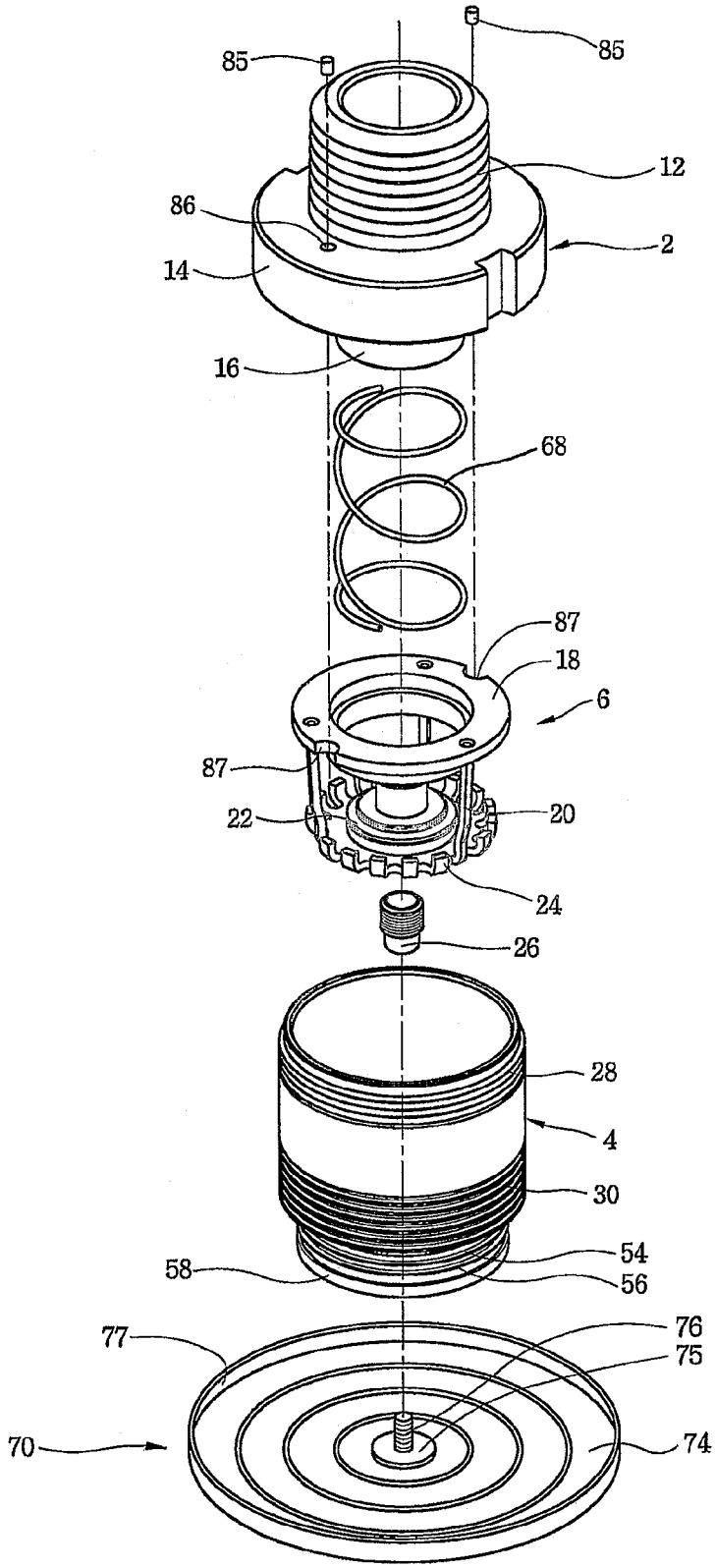
FIG. 13 is a disassembled perspective view of a sprinkler head according to another embodiment of the present invention.
Figure 14:
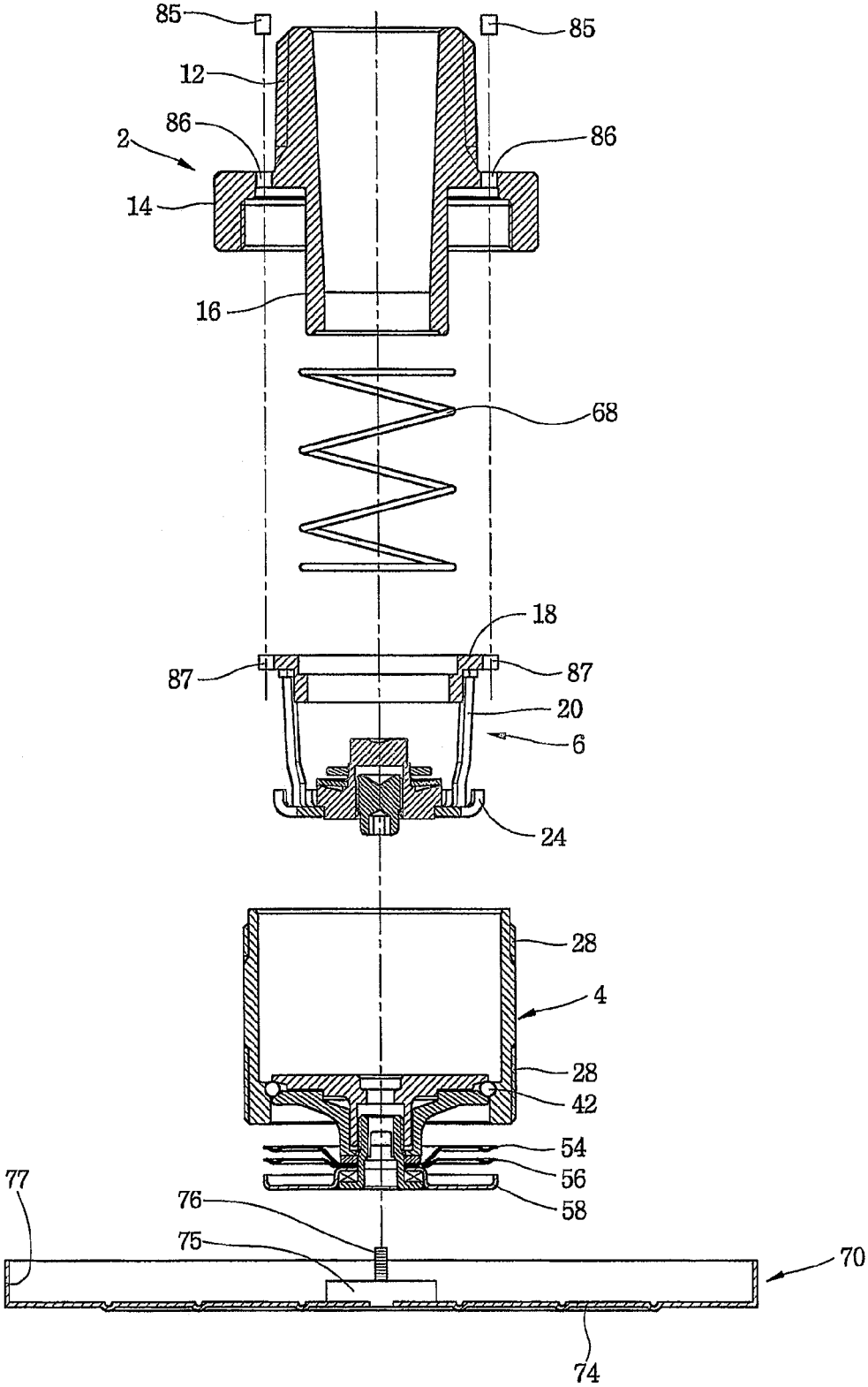
FIG. 14 is a disassembled sectional view of the sprinkler head according to another embodiment of the present invention.
Figure 15:
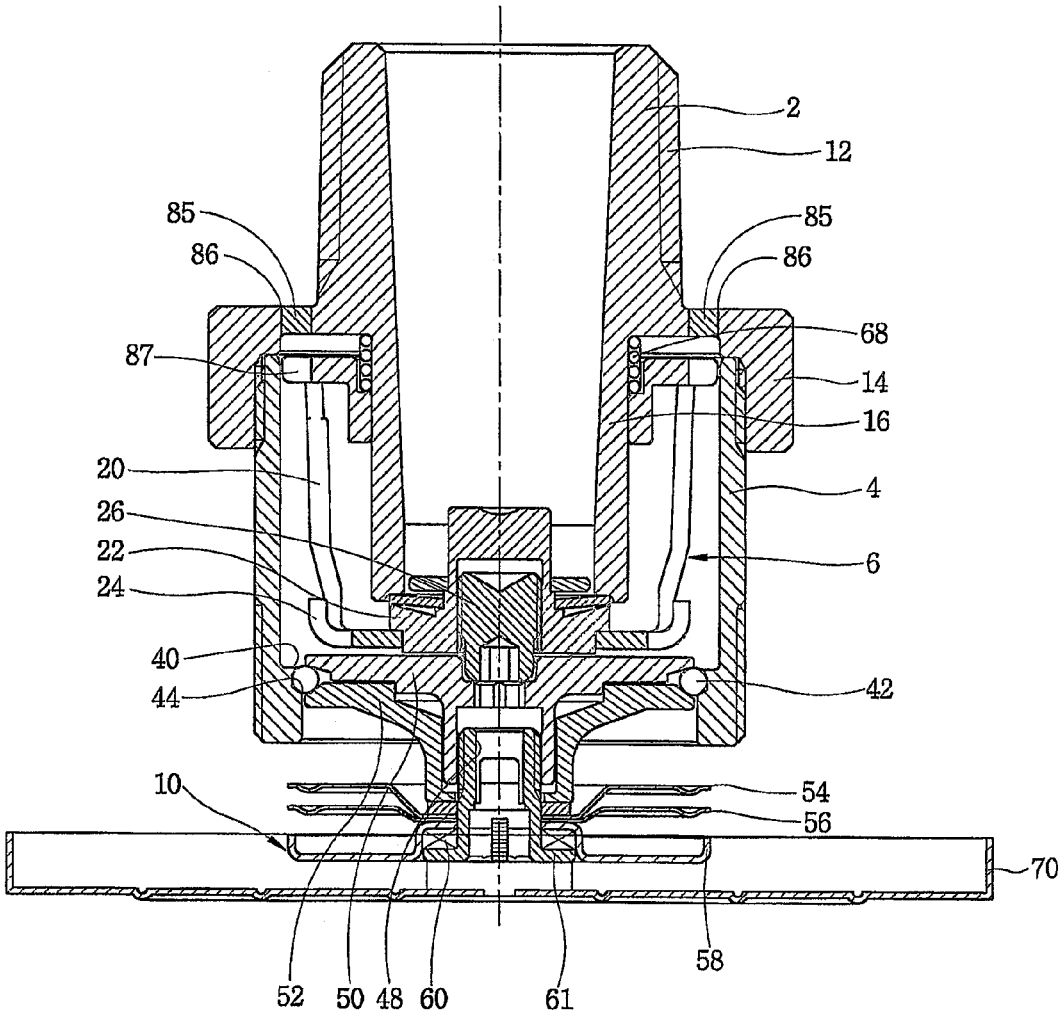
FIG. 15 is an engagement sectional view of the sprinkler head according to another embodiment of the present invention.

FIG. 13 is a disassembled perspective view of a sprinkler head according to another embodiment of the present invention, FIG. 14 is a disassembled sectional view of the sprinkler head according to another embodiment of the present invention, and FIG. 15 is an engagement sectional view of the sprinkler head according to another embodiment of the present invention.

The sprinkler head according to another embodiment has the same structure as the sprinkler head according to the first embodiment except a structure for supporting the deflector 6 not to be rotated when the set screw 26 coupled to the deflector 6 is loosened in order to adhere the sealing cap 18 of the deflector 6 to the lower surface of the water emitting unit 16 of the first housing 2.

In the sprinkler head according to another embodiment of the present invention, a tool insertion hole 86 for inserting a tool is formed at the flange portion 14 of the first housing 2 in a vertical direction, and a supporting groove 87 to which the tool that has passed the tool insertion hole 86 is inserted for supporting the deflector 6 not to be rotated is formed at the deflector ring 18.

Also, a packing member 85 is fitted into the tool insertion hole 86, thereby preventing foreign materials, moisture, and etc. from being introduced into the sprinkler head through the tool insertion hole 86.

An assembly process of the sprinkler head according to another embodiment of the present invention will be explained. First, a tool is inserted into the supporting groove 87 formed at the deflector ring 18 through the tool insertion hole 86, and then the set screw 26 is loosened, thereby adhering the sealing cap 22 of the deflector 6 to the lower surface of the water emitting portion 16 of the first housing 2. Then, the tool is extracted from the tool insertion hole 86, and the packing member 85 is forcibly fitted into the tool insertion hole 86, thereby sealing the tool insertion hole 86.

According to this, foreign materials, moisture, and etc. can be prevented from being introduced into the sprinkler head through the tool insertion hole 86.

Figure 16:
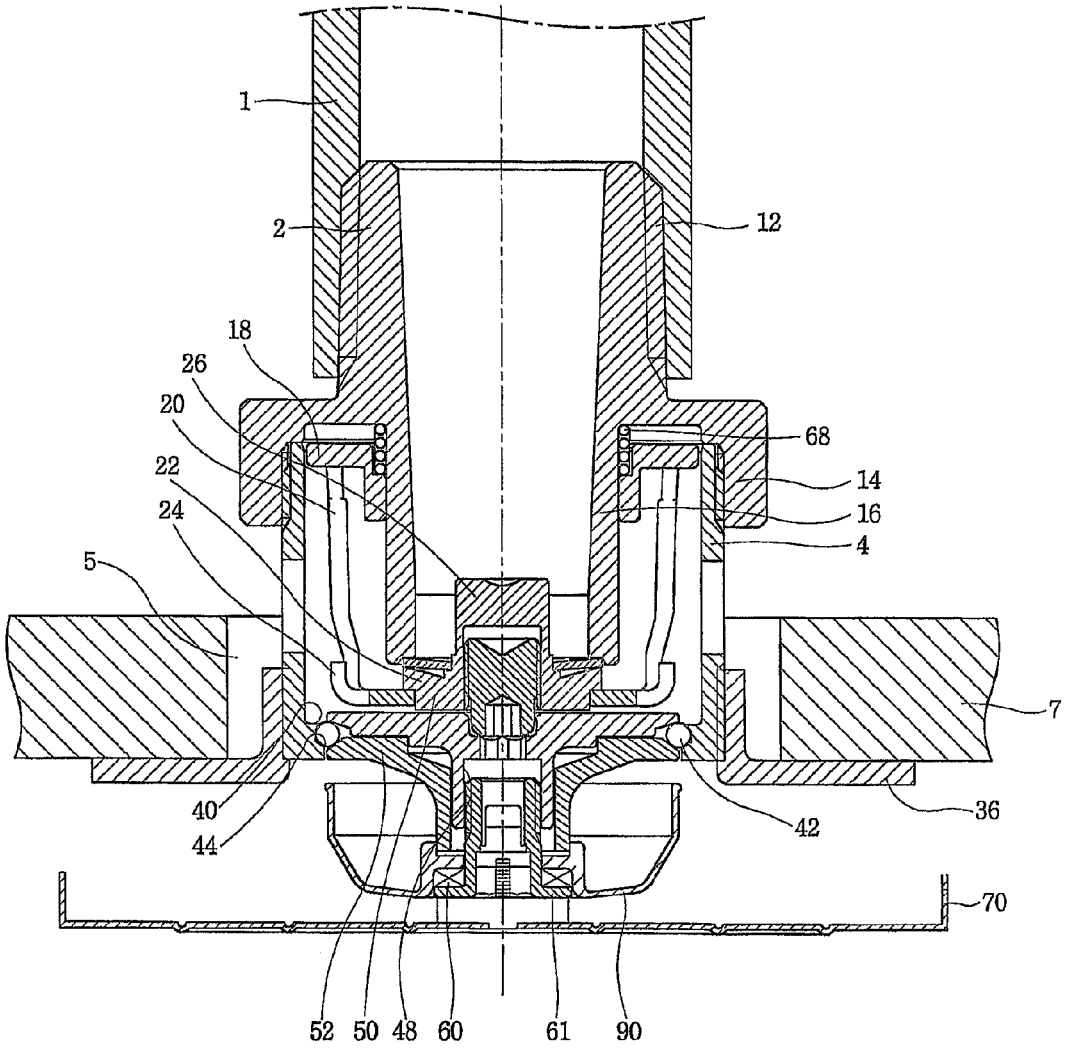
FIG. 16 is a sectional view of a sprinkler head according to still another embodiment of the present invention.

FIG. 16 is a sectional view of a sprinkler head according to still another embodiment of the present invention.

The sprinkler head of FIG. 16 has the same structure as the first embodiment except a heat collecting plate. The sprinkler head of FIG. 16 is provided with a heat collecting member 90 of a cup shape instead of the plurality of heat collecting plates of the first embodiment, and the head cover 70 is disposed at a lower side surface of the heat collecting member 90 with a certain interval with the heat collecting member 90.

The head cover 70 is the same as the head cover aforementioned in the first embodiment, thereby omitting its explanation.

In the sprinkler head according to the present invention, the head cover is installed at the lower side of the heat responding unit, thereby preventing the heat responding unit and the opening of the ceiling from being exposed to outside and thereby having a fine appearance. Also, the head cover is disposed with a certain interval with the ceiling, so that the head cover collects heat at the time of a fire occurrence and at the same time heated air is introduced into the heat responding unit. According to this, a reaction speed is quickened and thereby a reliability of the product can be enhanced.

Additionally, foreign materials, moisture, and etc. are prevented from being introduced into the sprinkler head by packing the tool insertion hole formed at the first housing or the second housing, thereby preventing a mis-operation of the sprinkler head.

It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A sprinkler head comprising:

a first housing connected to a water supply pipe;

a second housing coupled to the first housing;

a deflector adhered to the first housing in a sealing-available manner, for spraying water all around at the time of a fire occurrence by being detached from the first housing;

a locking unit locked inside the second housing for maintaining the sealing state between the deflector and the first housing;

a plurality of heat collecting plates exposed to outside of the ceiling, for heat-collecting at the time of a fire occurrence, each of said plurality of heat collecting plates being arranged such that a gap is defined between said each of said plurality of heat collecting plates and an adjacent one of said plurality of heat collecting plates so that heated air can pass through the gap;

a heat responding unit having the fuse metal for releasing the locking state of the locking unit when the fuse metal is melted by heat collected into the heat collecting plates, said plurality of heat collecting plates being in direct contact with the fuse metal; and a head cover mounted at a lower side of the heat responding unit with a certain interval for covering the heat responding unit not to expose to outside and for heat-collecting at the time of a fire occurrence and thereby transmitting the heat to the heat responding unit, said head cover having a disc for heat-collecting, a heat transmission plate attached to the center of an upper surface of the disc, for transmitting heat collected by the disc to the heat responding unit, and a couple member formed at an upper surface of the heat transmission plate and coupled to the heat responding unit.

2. The sprinkler head of claim 1, wherein the disc has a diameter larger than a diameter of the plurality of heat collecting plates, and is provided with a flange portion protruded upwardly at the outer edge thereof.

3. The sprinkler head of claim 1, wherein the disc is provided with a plurality of ribs formed with a certain interval in a circumferential direction thereof for reinforcing an intensity.

4. The sprinkler head of claim 2, wherein a certain interval is formed between an upper surface of the flange portion of the disc of the head cover and the ceiling surface in order to introduce heated air into the heat collecting plates.

5. The sprinkler head of claim 1, wherein the heat transmission plate of the head cover is mounted between the heat collecting plates and the disc and has a certain thickness for maintaining a certain clearance therebetween.

6. The sprinkler head of claim 3, wherein the heat transmission plate is in contact with a lower surface of a locking screw for integrally coupling the locking unit and the heat responding unit, and has a diameter smaller than a diameter of a head portion of the locking screw.

7. The sprinkler head of claim 1, wherein the couple member is composed of a screw bar perpendicularly protruded at an upper surface of the heat transmission plate thus to be coupled to the heat responding unit by a screw.

8. The sprinkler head of claim 1, wherein the couple member is composed of a locking hook perpendicularly protruded with a certain interval in a circumferential direction of the disc and having a locking protrusion at the end portion thereof thus to be locked at the heat collecting plate.

9. The sprinkler head of claim 1 further comprising a cover member coupled to an outer circumferential surface of the second housing and adhered to the ceiling surface, for covering an opening of the ceiling to which the sprinkler head is inserted.

10. The sprinkler head of claim 9, wherein the cover member includes:

a plate portion formed as a disc shape of which the center is open and adhered to an outer side surface of the ceiling; and a couple portion protruded from an upper side surface of the plate portion thus to be coupled to a second male screw portion of the second housing.

11. The sprinkler head of claim 10, wherein the couple portion is formed as a cylindrical shape that a female screw portion is formed at an inner circumferential surface thereof.

12. The sprinkler head of claim 10, wherein the couple portion is formed at a circumferential surface of the plate portion with a certain interval and has a plurality of protrusions locked at the second male screw portion of the second housing at an inner surface thereof.

13. The sprinkler head of claim 1 further comprising a hole cover mounted at an outer circumferential surface of the second housing, for covering a tool insertion hole formed at the second housing.

14. The sprinkler head of claim 13, wherein the hole cover is formed as a cylindrical shape that is inserted into an outer circumferential surface of the second housing in a sealingable manner.

15. The sprinkler head of claim 13, wherein a first male screw portion and a second male screw portion are respectively formed at upper and lower sides of the outer circumferential surface of the second housing, and the hole cover is mounted at an outer surface between the first male screw portion and the second male screw portion.

16. The sprinkler head of claim 14, wherein an upper surface of the hole cover is provided with a rib outwardly extended so as to be adhered to a lower surface of the flange portion of the first housing.

17. The sprinkler head of claim 14, wherein the hole cover is mounted at the outer circumferential surface of the second housing by a forcible inserting method.

18. The sprinkler head of claim 1, wherein a flange portion of the first housing is provided with a tool insertion hole for inserting a tool, a supporting groove to which the tool that has passed the tool insertion hole is inserted for supporting the deflector not to be rotated is formed at a deflector ring of the deflector, and a packing member for covering the tool insertion hole is fitted into the tool insertion hole.

19. The sprinkler head of claim 1, wherein said plurality of heat collecting plates are arranged one directly on top of the other in a stack, each of said heat collecting plates having a central section and a radially outer section, said gap being defined between said radially outer sections of adjacent ones of said heat collecting plates.

* * * * *